US011882909B2

(12) United States Patent
Joseph

(10) Patent No.: US 11,882,909 B2
(45) Date of Patent: Jan. 30, 2024

(54) MODULAR PENDANT

(71) Applicant: Adam Joseph, Brooklyn, NY (US)

(72) Inventor: Adam Joseph, Brooklyn, NY (US)

( * ) Notice: Subject to any disclaimer, the term of this patent is extended or adjusted under 35 U.S.C. 154(b) by 41 days.

(21) Appl. No.: 17/533,191

(22) Filed: Nov. 23, 2021

(65) Prior Publication Data

US 2022/0079306 A1 Mar. 17, 2022

(51) Int. Cl.
*A44C 25/00* (2006.01)
*A44C 15/00* (2006.01)

(52) U.S. Cl.
CPC ..... *A44C 15/001* (2013.01); *A44C 25/001* (2013.01)

(58) Field of Classification Search
CPC ..... A44C 5/02; A44C 15/001; A44C 25/001; A44C 5/10; A44C 5/105; A44C 11/00
USPC ..... D11/1, 12, 79, 80, 86, 93; 63/21, 38, 40
See application file for complete search history.

(56) References Cited

U.S. PATENT DOCUMENTS

| | | | | | |
|---|---|---|---|---|---|
| 324,582 | A * | 8/1885 | Obrig | A44C 11/00 | D11/18 |
| 420,508 | A * | 2/1890 | Blassing | A44C 25/001 | 63/23 |
| D40,385 | S * | 12/1909 | Leding | D11/79 | |
| 1,797,703 | A * | 3/1931 | Sulger | A44C 15/001 | D11/7 |
| D109,736 | S * | 5/1938 | Sand | D11/12 | |
| 2,228,686 | A * | 1/1941 | Albert | A44C 15/001 | 63/1.17 |
| 2,417,289 | A * | 3/1947 | Bisso | A44C 5/105 | D11/15 |
| 2,807,928 | A * | 10/1957 | Arnold | A44C 5/02 | 59/80 |
| 5,341,634 | A * | 8/1994 | Straight | A44C 11/00 | 59/91 |
| 5,664,410 | A * | 9/1997 | Nydick | A44C 11/00 | 59/80 |
| D769,771 | S * | 10/2016 | Tanory, Jr. | D11/96 | |
| D918,767 | S * | 5/2021 | Newell | D11/79 | |
| 2004/0020243 | A1* | 2/2004 | Molino | A44C 15/001 | 63/31 |
| 2008/0256980 | A1* | 10/2008 | Bennett | A44C 25/001 | 63/33 |
| 2020/0275747 | A1* | 9/2020 | Newell | A44C 25/001 | |

FOREIGN PATENT DOCUMENTS

| | | | | |
|---|---|---|---|---|
| EP | 2524615 | A1 * | 11/2012 | A44C 13/00 |
| KR | 200380796 | Y1 * | 1/2013 | |

* cited by examiner

*Primary Examiner* — Emily M Morgan

(57) ABSTRACT

The present invention discloses a jewelry pendant that is used by suspending it to a decorative piece such as a thread or chain to which the pendant is mounted. The pendant is modular in nature and thus different configuration may be formed by interconnecting various pieces or components of the pendant with each other. The components are connected in such a way that each component can rotate around the hinged connection. Various configurations of pendant include at least one of, but is not limited to, a straight configuration, a circular configuration, a triangular configuration, a square configuration, a double circle configuration, a double rectangle configuration, or a cubical configuration. The pendant may be used as a necklace piece, an earring, a key ring, or a bracelet. In some other applications, the pendant may be used as a decorative piece on a bag, purse, or belt.

10 Claims, 21 Drawing Sheets

MODULAR PENDANT

FIELD OF THE INVENTION

The present application generally relates to a wearable device, and more particularly to a jewelry pendant that is used by suspending it to a decorative piece such as a thread or chain to which the pendant is mounted. The pendant is modular in nature and thus different configurations may be formed by interconnecting various pieces of the pendant with each other. The pendant is primarily designed to be hung from necklaces and bracelets, but which could also be used as earrings, pins, clasps, and broaches without limiting to the scope of the present invention.

BACKGROUND

Generally, most pieces of jewelry are configured as integral, unitary components. While many are beautiful and often expensive, they are usually designed to be worn only in a single configuration and, as a result, their versatility is limited to that singular appearance. It is rare for a piece of jewelry to be modifiable to allow that single piece to be worn in a plurality of display positions. The limited, relevant prior art reflects jewelry which can be worn in several different configurations. However, such prior jewelry pieces and those similar in the prior art fail to provide for the modification and resulting versatility of the present invention, which presents a myriad of options to the creator and especially to the wearer of expensive jewelry. In light of the foregoing, there is a need for a modular pendant that can solve the above-mentioned problems in an efficient and effective manner and which is easy to reconfigure and use. Furthermore, the modular pendant should be affordable, easy to assemble, and carry. Therefore, the embodiments of the present invention create a system to address the above.

SUMMARY

It will be understood that this disclosure is not limited to the particular systems, configurations, and methodologies described herein, as there can be multiple possible embodiments of the present disclosure which are not expressly illustrated in the present disclosure. It is also to be understood that the terminology used in the description is for the purpose of describing the particular versions or embodiments only and is not intended to limit the scope of the present disclosure.

It is an object of the present invention to provide a modular pendant that is easy to reconfigure from one design to another design. It is a further object of the present invention to provide a pendant whose appearance is easily, reliably, and quickly modified to various display positions. It is a further object of the present invention to provide a pendant which can easily, reliably, and quickly be modified to present a plurality of different aesthetic appearances in a single piece of jewelry.

These and other features and advantages of the present invention will become apparent from the detailed description below, considering the accompanying drawings.

BRIEF DESCRIPTION OF ACCOMPANYING DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of various examples. It is expressly understood, however, that the drawings are for the purpose of illustration and description only and are not intended as a definition of the limits of the invention. Embodiments of this invention will now be described by way of example in association with the accompanying drawings in which:

Figure 19A:
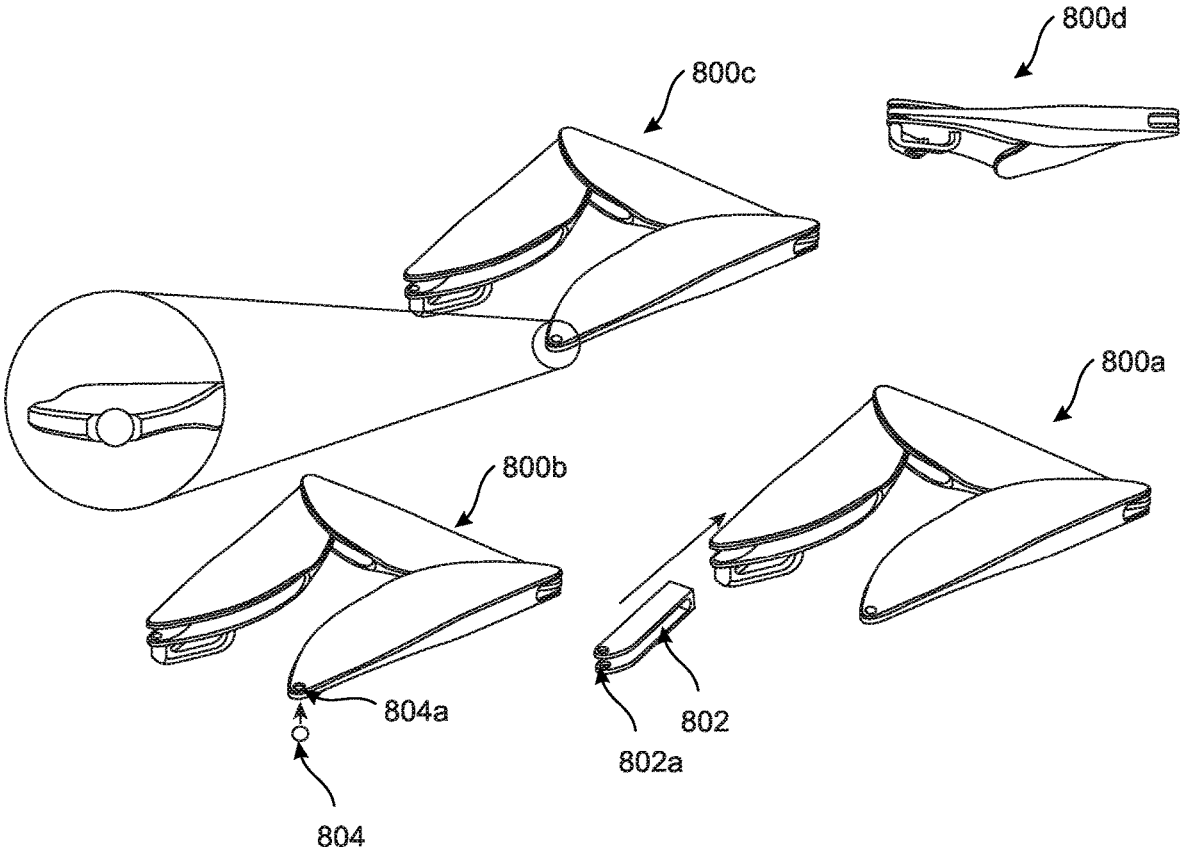
Figure 19B:
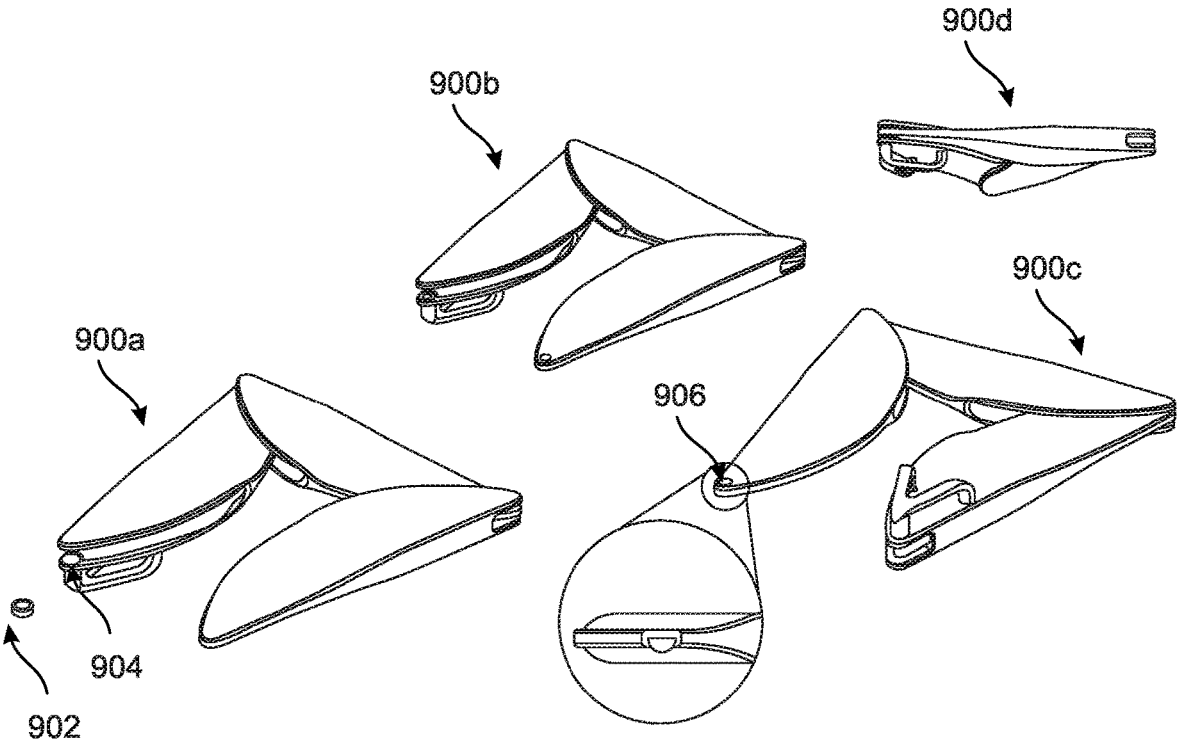
Figure 19C:
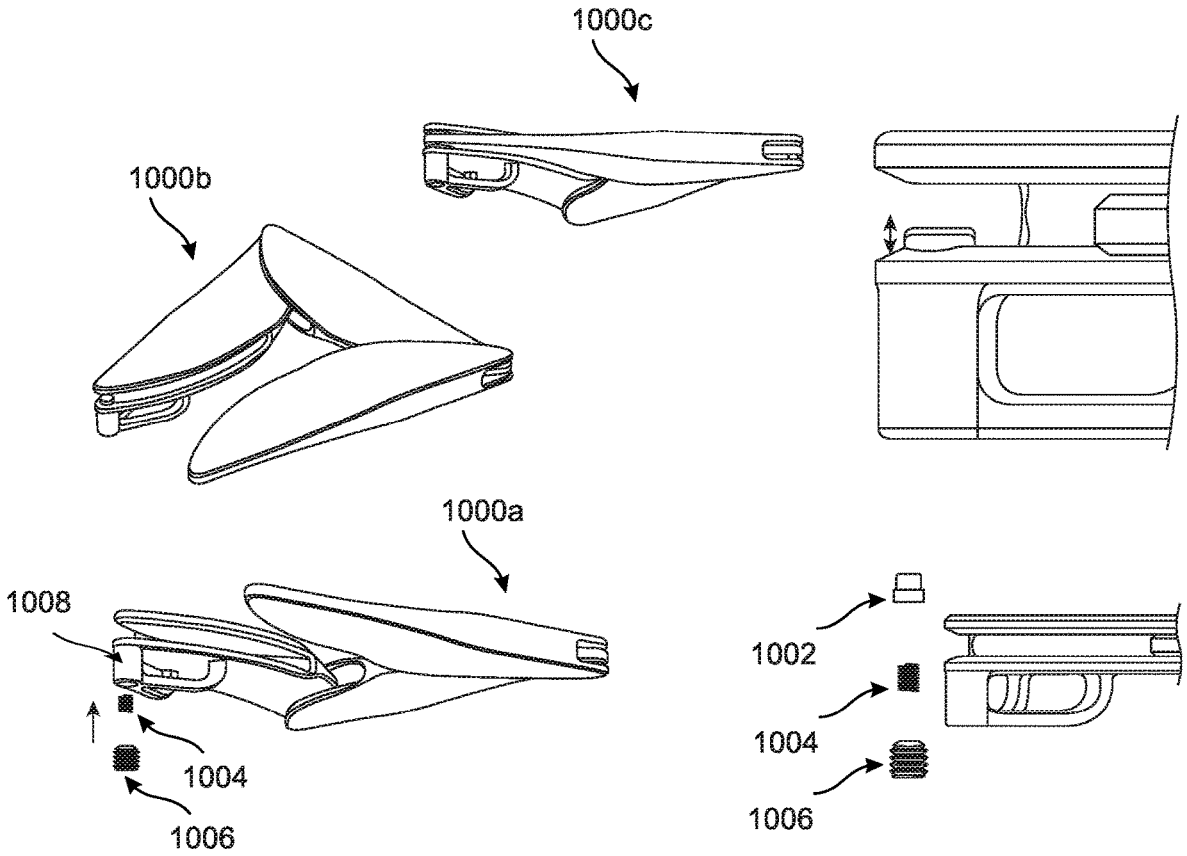

FIGS. 19*a*, 19*b*, and 19*c* are diagrams that illustrate different clasping mechanisms for the wearable device, according to an exemplary embodiment of the present invention.

DETAILED DESCRIPTION

As used in the specification and claims, the singular forms "a", "an", and "the" may also include plural references. For example, the term "an article" may include a plurality of articles. Those with ordinary skill in the art will appreciate that the elements in the figures are illustrated for simplicity and clarity and are not necessarily drawn to scale. For example, the dimensions of some of the elements in the figures may be exaggerated, relative to other elements, in order to improve the understanding of the present invention. There may be additional components described in the foregoing application that are not depicted on one of the described drawings. In the event such a component is described, but not depicted in a drawing, the absence of such a drawing should not be considered as an omission of such design from the specification.

Before describing the present invention in detail, it should be observed that the present invention utilizes a combination of components, which constitutes a modular pendant that is easy to reconfigure from one design to another design and whose appearance is easily, reliably, and quickly modified to various display positions. Accordingly, the components have been represented, showing only specific details that are pertinent for understanding of the present invention so as not to obscure the disclosure with details that will be readily apparent to those with ordinary skill in the art having the benefit of the description herein. As required, detailed embodiments of the present invention are disclosed herein; however, it is to be understood that the disclosed embodiments are merely exemplary of the present invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the present invention.

References to "one embodiment", "an embodiment", "another embodiment", "yet another embodiment", "one example", "an example", "another example", "yet another example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment.

The words "comprising", "having", "containing", and "including", and other forms thereof, are intended to be equivalent in meaning and be open ended in that an item or items following any one of these words is not meant to be an exhaustive listing of such item or items or meant to be limited to only the listed item or items.

The modular pendant of the present invention will now be described with reference to the accompanying drawings FIGS. 1-18, which should be regarded as merely illustrative without restricting the scope and ambit of the present invention.

Figure 1:
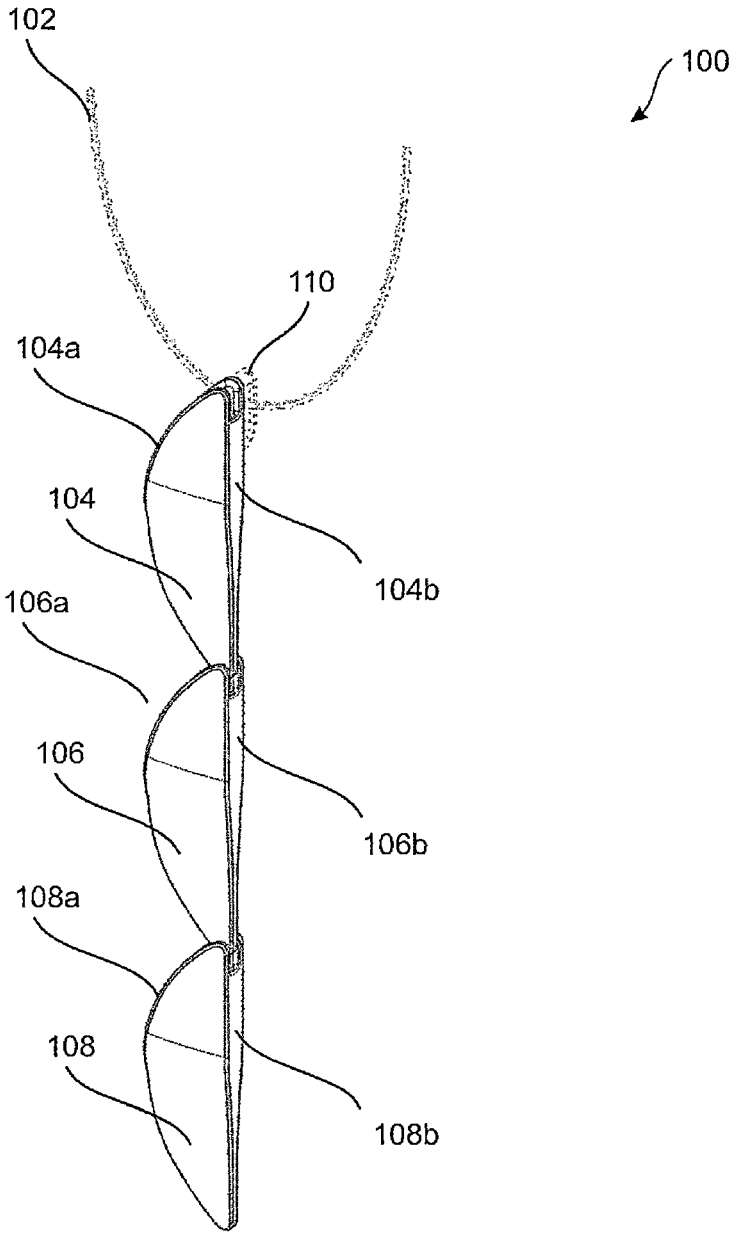
FIG. 1 is a diagram that illustrates a perspective view of a wearable device in a straight configuration, according to an exemplary embodiment of the present invention.
Figure 2:
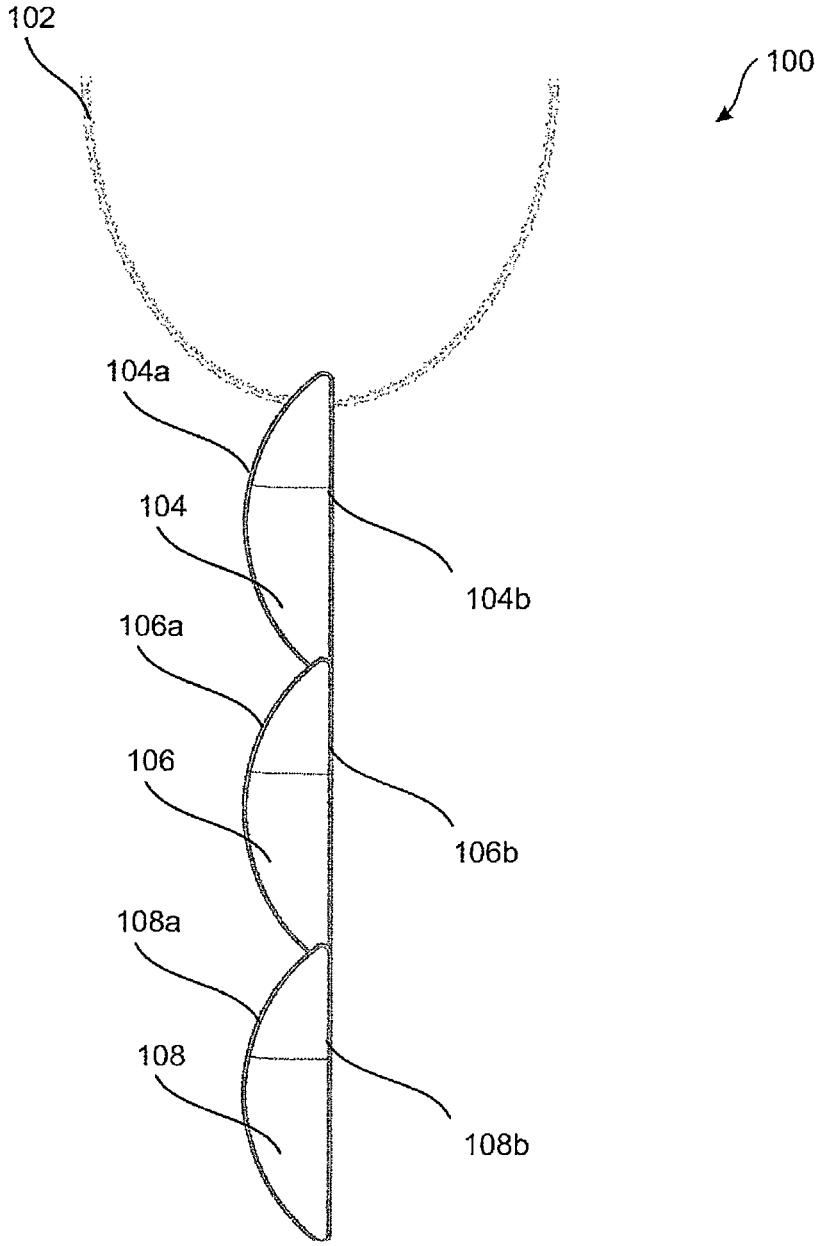
FIG. 2 is a diagram that illustrates a front view of the wearable device in the straight configuration, according to an exemplary embodiment of the present invention.
Figure 3:
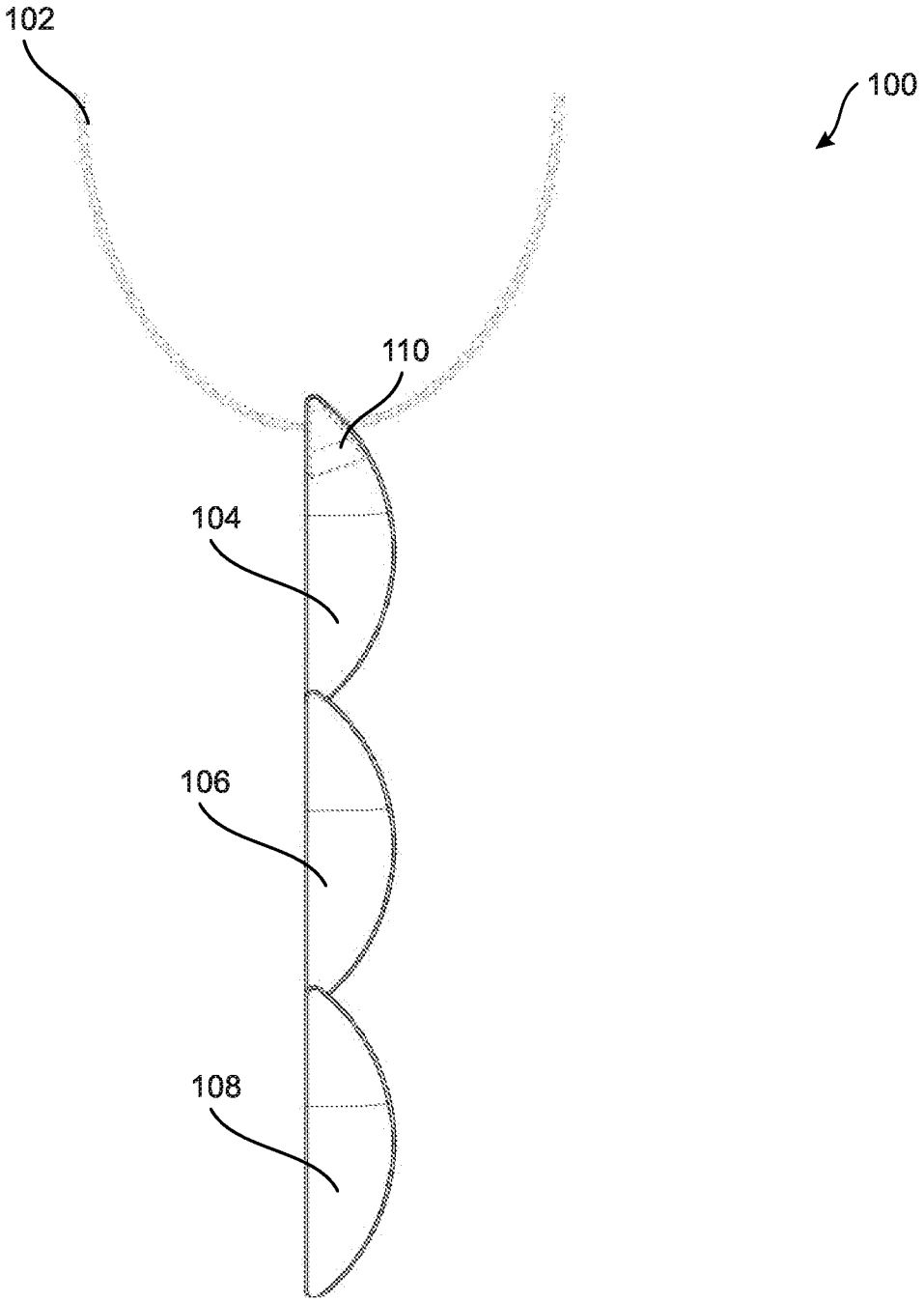
FIG. 3 is a diagram that illustrates a rear view of the wearable device in the straight configuration, according to an exemplary embodiment of the present invention.
Figure 4:
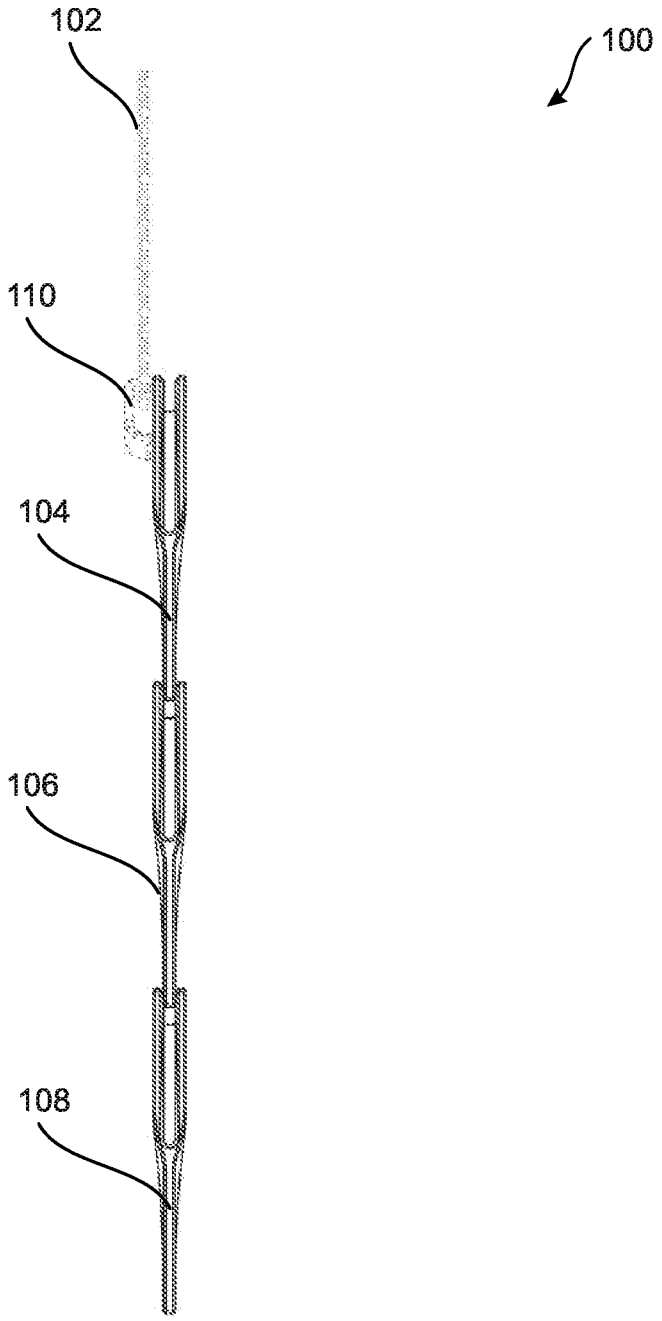
FIGS. 4 and 5 are diagrams that illustrate side views of the wearable device in the straight configuration, according to an exemplary embodiment of the present invention.
Figure 5:
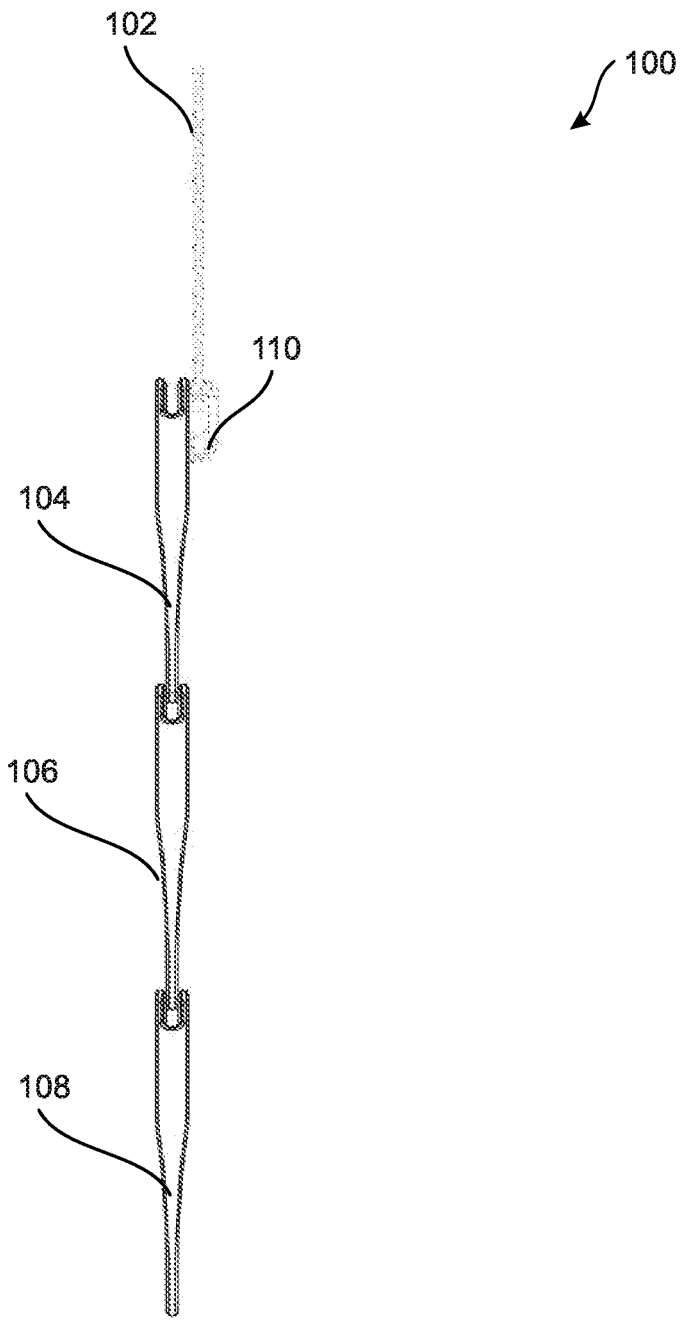
Figure 6:
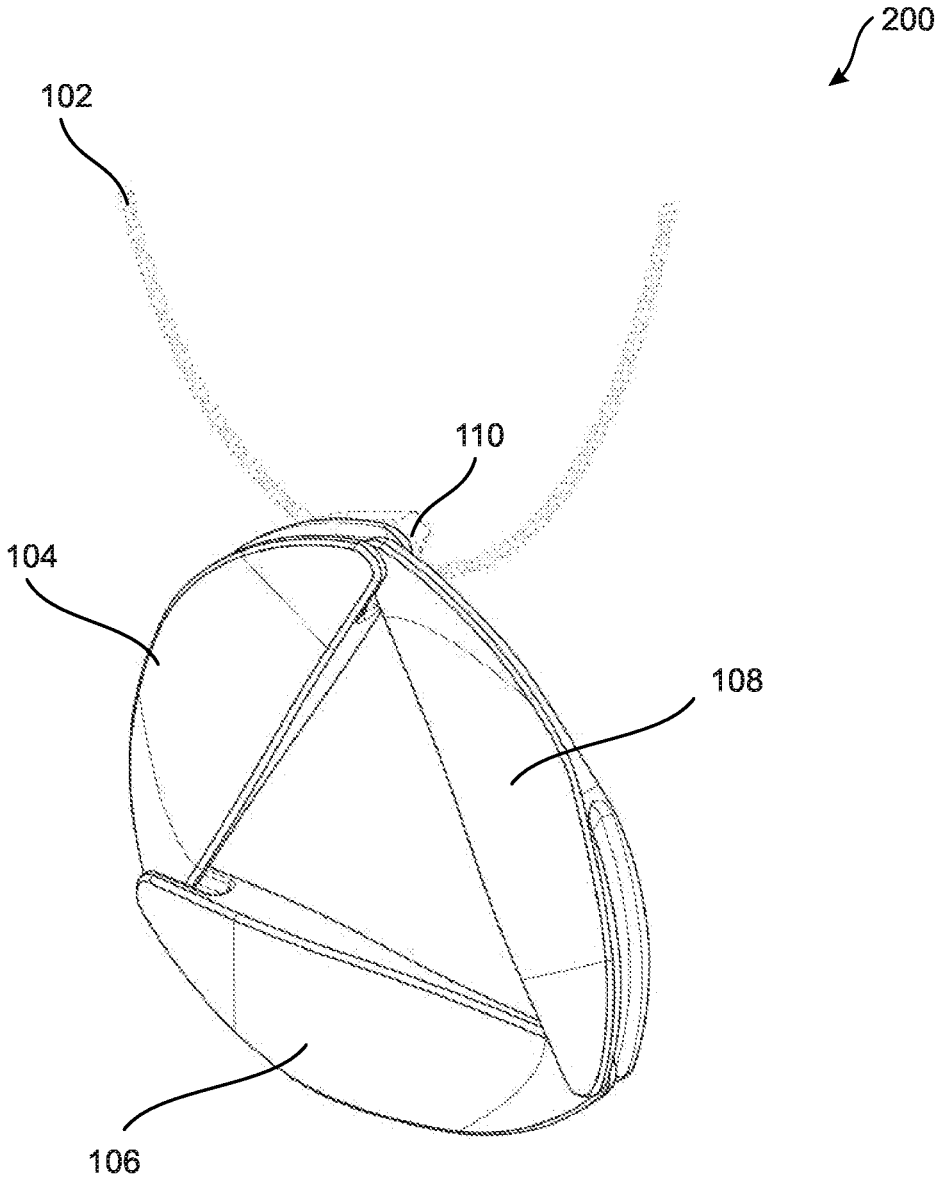
FIG. 6 is a diagram that illustrates a perspective view of the wearable device in a circular configuration, according to another exemplary embodiment of the present invention.
Figure 7:
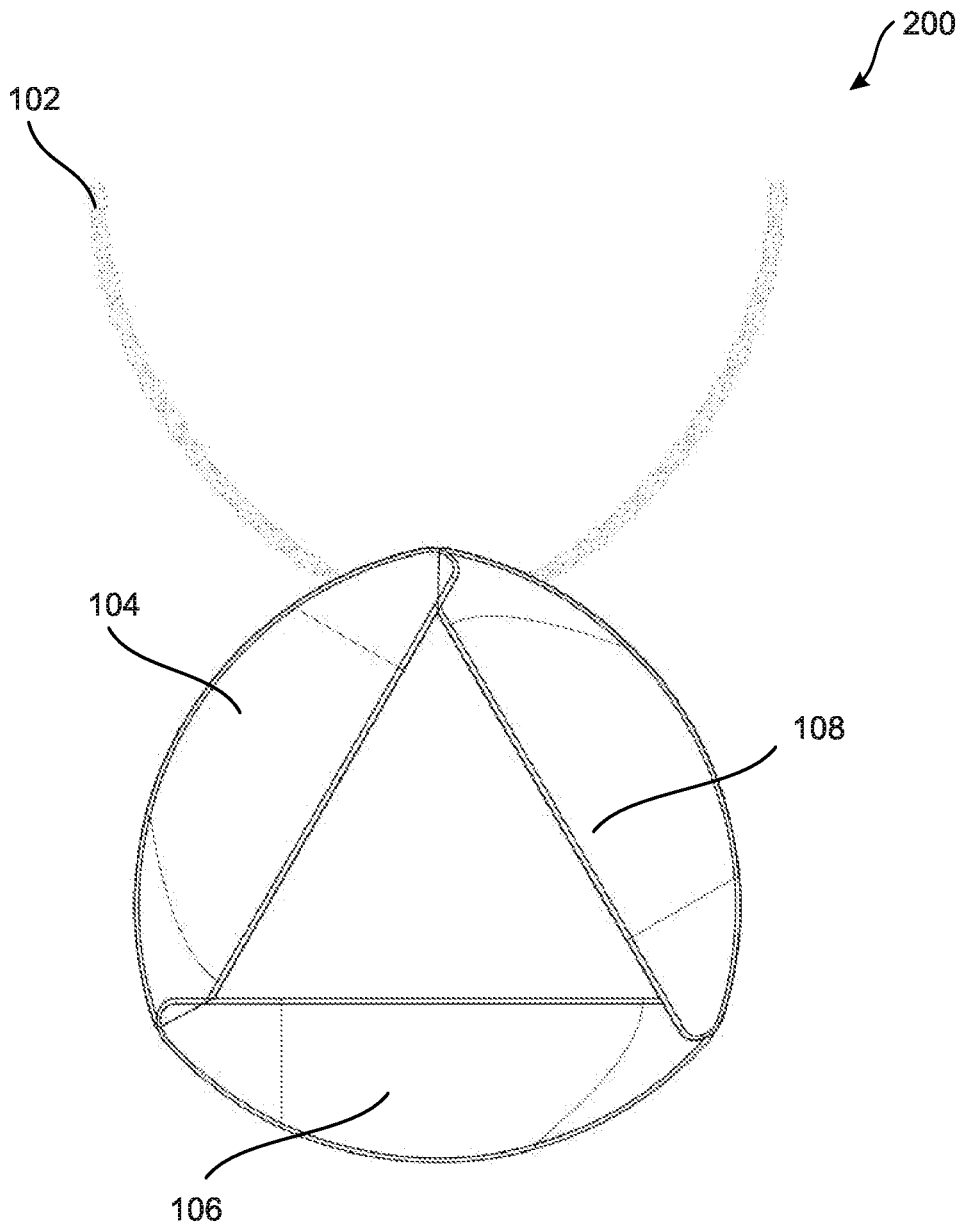
FIG. 7 is a diagram that illustrates a front view of the wearable device in the circular configuration, according to another exemplary embodiment of the present invention.
Figure 8:
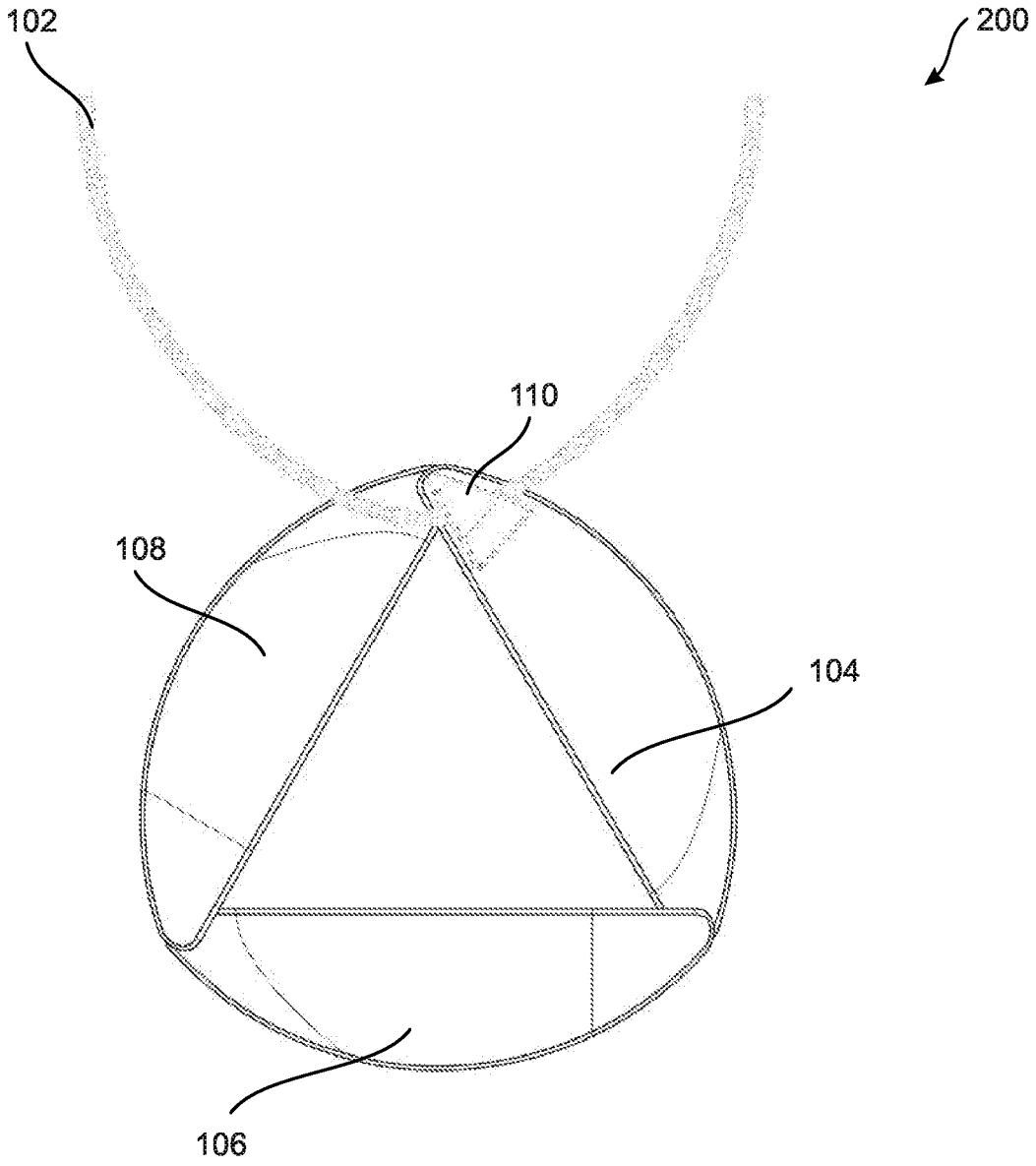
FIG. 8 is a diagram that illustrates a rear view of the wearable device in the circular configuration, according to another exemplary embodiment of the present invention.
Figure 9:
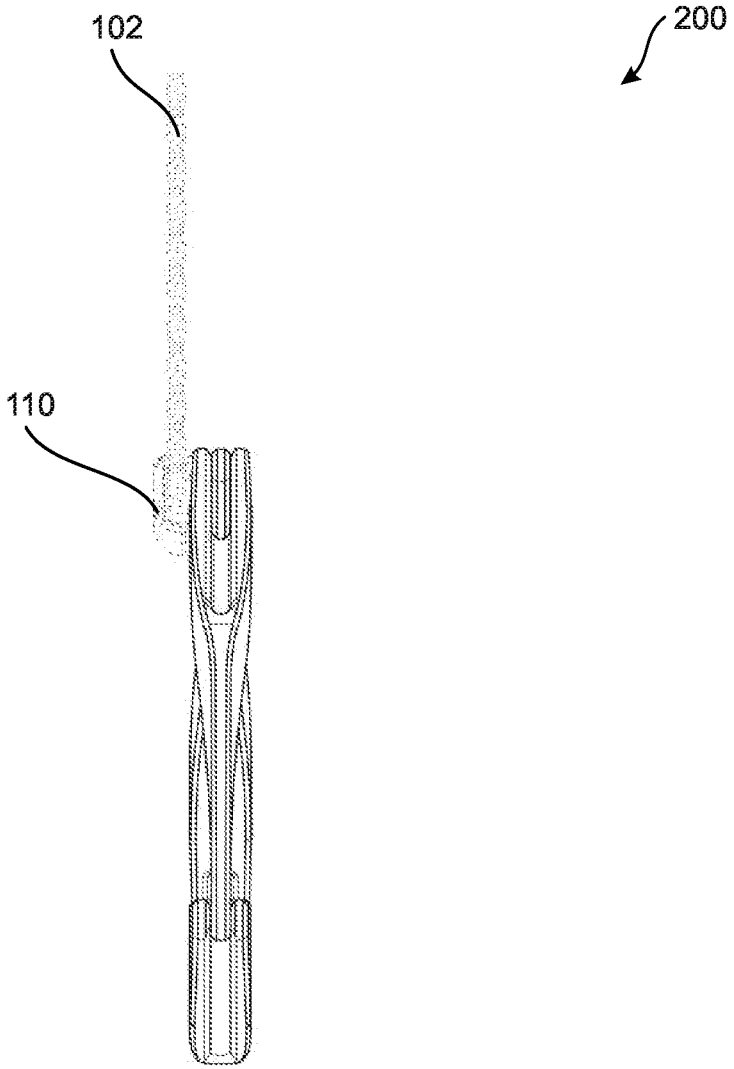
FIG. 9 is a diagram that illustrates a side view of the wearable device in the circular configuration, according to another exemplary embodiment of the present invention.

FIG. 1 is a diagram that illustrates a perspective viewof a wearable device 100 in a straight configuration, according to an exemplary embodiment of the present invention. FIG. 2 is a diagram that illustrates a front view of the wearable device 100 in the straight configuration, according to an exemplary embodiment of the present invention. FIG. 3 is a diagram that illustrates a rear view of the wearable device 100 in the straight configuration, according to an exemplary embodiment of the present invention. FIGS. 4 and 5 are diagrams that illustrate side views of the wearable device 100 in the straight configuration, according to an exemplary embodiment of the present invention. The wearable device 100 corresponds to a pendant that is designed to be hung from a necklace or a bracelet. The pendant may also be used as earrings, pins, and broaches, or it can be used as a clasping mechanism, but should be construed as limiting to the scope of the present invention. In an exemplary embodiment, the pendant has been hung through a wearable such as a neckpiece or necklace 102. The neckpiece may be made up of a metallic, plastic, or thread material. In an embodiment, the pendant includes a plurality of components such as a first component 104, a second component 106, and a third component 108. Each component may be made up of a metallic or plastic material but should not be construed as limiting to the scope of the present invention. In some use cases, the components may be made using elastic material, stone, or wooden piece. Each component has three closing surfaces and one open surface. Each component has a thinner end portion (without any opening) and a thicker end portion (with an opening). However, in some of the use cases, each component may be included with openings at both ends. Further, each component includes a curvy portion (as shown by 104*a*, 106*a*, and 108*a*) and a flat portion (as shown by 104*b*, 106*b*, and 108*b*), and they are opposite to each other. Further, all components may appear the same way, for example, they are similar in terms of their shape and size. In an embodiment, the first component 104 includes a clasp or hook 110 located on a rear side, as shown. However, in some use cases, the clasp or hook 110 may be provided on a front or top side without limiting the scope of the present invention. The clasp 110 has an opening through which the necklace 102 may pass through. In an embodiment, at least two of the plurality of components are connected to each other in a hinged manner. For example, the first component 104 is connected to the second component 106 in a hinged manner such that the components can rotate around the hinged connection. Here, the thinner end portion of the first component 104 goes into the opening of the thicker end of the second component 106 and are then connected together in the hinged manner by using appropriate means such as screws or others that are known in the art. Similarly, the second component 106 is connected to the third component 108 in a hinged manner such that the components can rotate around the hinged connection FIG. 6 is a diagram that illustrates a perspective view of the wearable device 200 in a circular configuration, according to another exemplary embodiment of the present invention. FIG. 7 is a diagram that illustrates a front view of the wearable device 200 in the circular configuration, according to another exemplary embodiment of the present invention. FIG. 8 is a diagram that illustrates a rear view of the wearable device 200 in the circular configuration, according to another exemplary embodiment of the present invention. FIG. 9 is a diagram that illustrates a side view of the wearable device 200 in the circular configuration, according to another exemplary embodiment of the present invention. The wearable device 100 corresponds to a pendant that is designed to be hung from the necklace 102. In an embodiment, the pendant includes a plurality of components such as the first component 104, the second component 106, and the third component 108. Each component has three closing surfaces and one open surface. Each component has a thinner end portion (without any opening) and a thicker end portion (with an opening). In an embodiment, the first component 104 includes the clasp or hook or affixing mechanism 110 located on a rear, front, or top side. The clasp 110 has an opening through which the necklace 102 may pass through. In an embodiment, the plurality of components are connected to each other in a hinged manner such that it forms a circular configuration as shown. For example, the first component 104 is connected to the second component 106 in a hinged manner such that the components can rotate around the hinged connection. Here, the thinner end portion of the first component 104 goes into the opening of the thicker end of the second component 106 and are then connected together in the hinged manner by using appropriate means such as screws or others that are known in the art. Similarly, the second component 106 is connected to the third component 108 in a hinged manner such that the components can rotate around the hinged connection. Thereafter, the thinner portion of the third component 108 is inserted into thicker portion of the first component 104 and are tightened or affixed to form a closed circular or loop configuration as shown. In this configuration, the opening on the thicker end of each component is on the exterior circumference as shown. This circular configuration of the pendant may be used with the necklace 102 that passes through the clasp 110 to form the wearable device. A user who intends to use this pendant may switch from the straight configuration to the circular configuration, or vice-versa in an easy and efficient manner.

Figure 10:
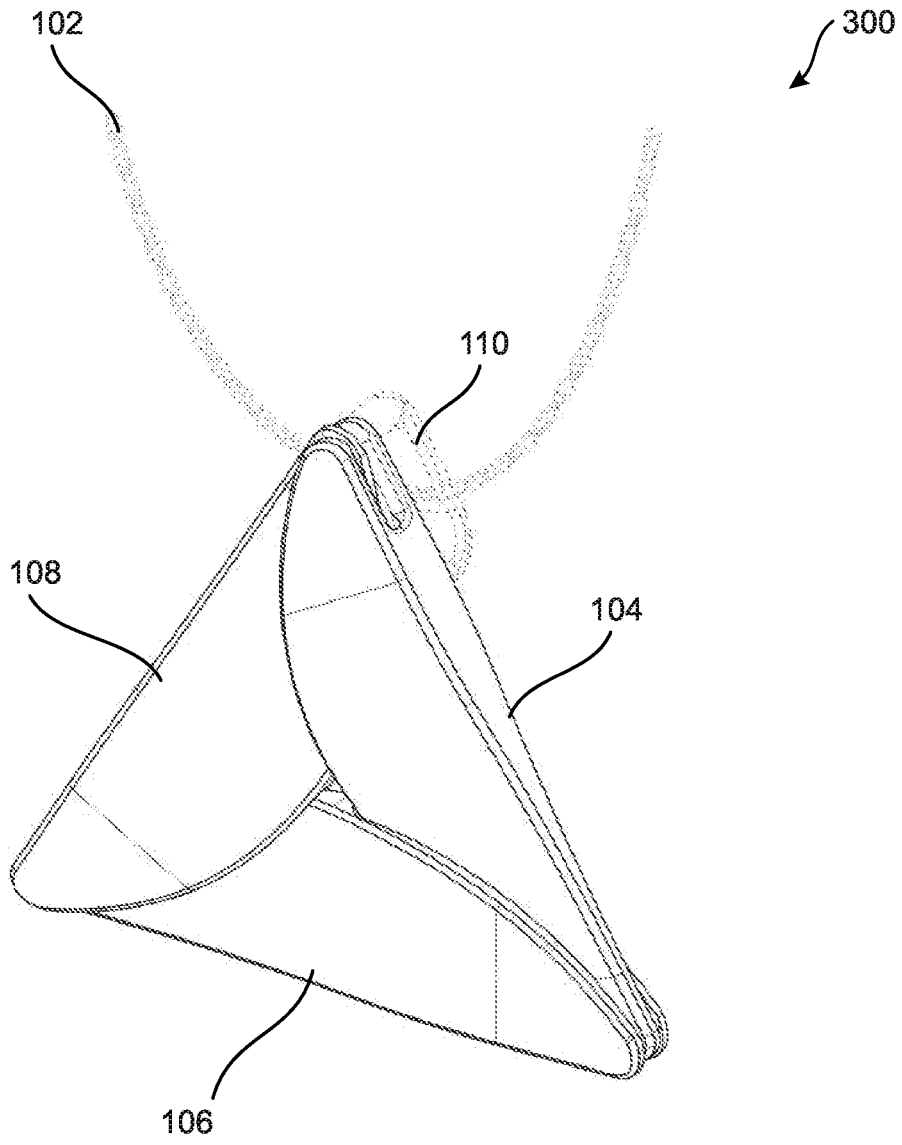
FIG. 10 is a diagram that illustrates a perspective view of the wearable device in a triangle configuration, according to another exemplary embodiment of the present invention.
Figure 11:
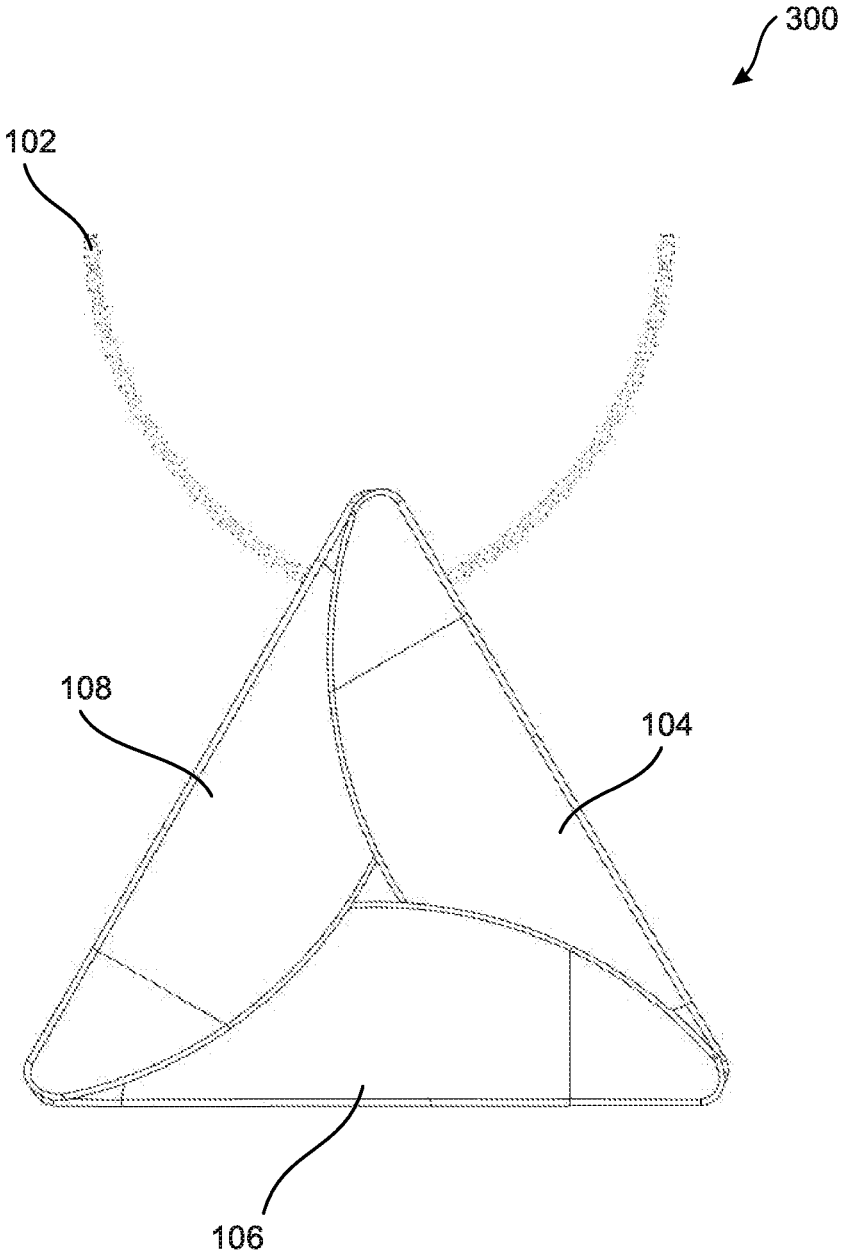
FIG. 11 is a diagram that illustrates a front view of the wearable device in the triangle configuration, according to another exemplary embodiment of the present invention.
Figure 12:
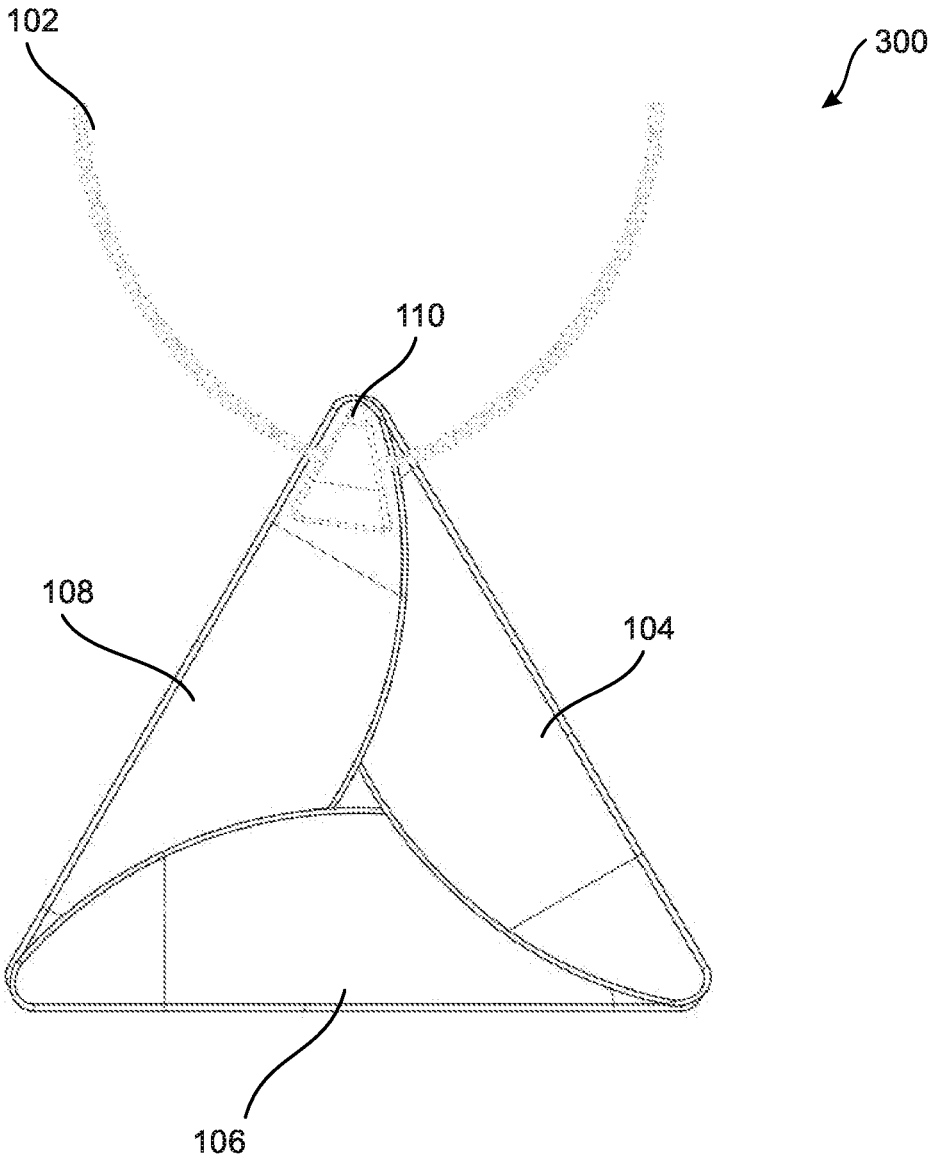
FIG. 12 is a diagram that illustrates a rear view of the wearable device in the triangle configuration, according to another exemplary embodiment of the present invention.
Figure 13:
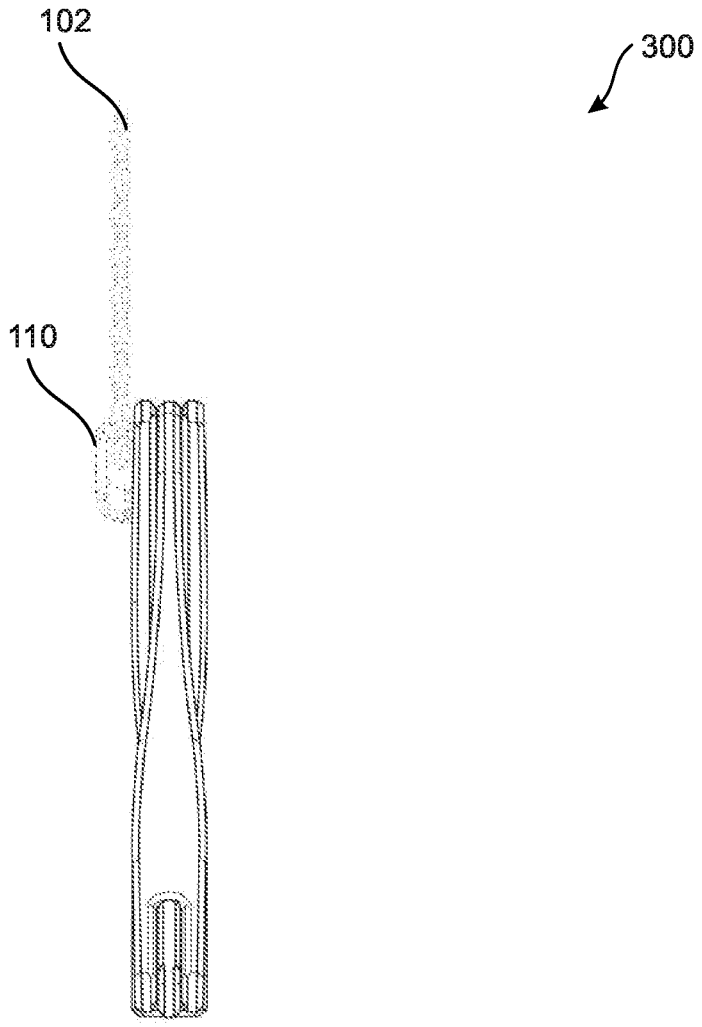
FIG. 13 is a diagram that illustrates a side view of the wearable device in the triangle configuration, according to another exemplary embodiment of the present invention.
Figure 14:
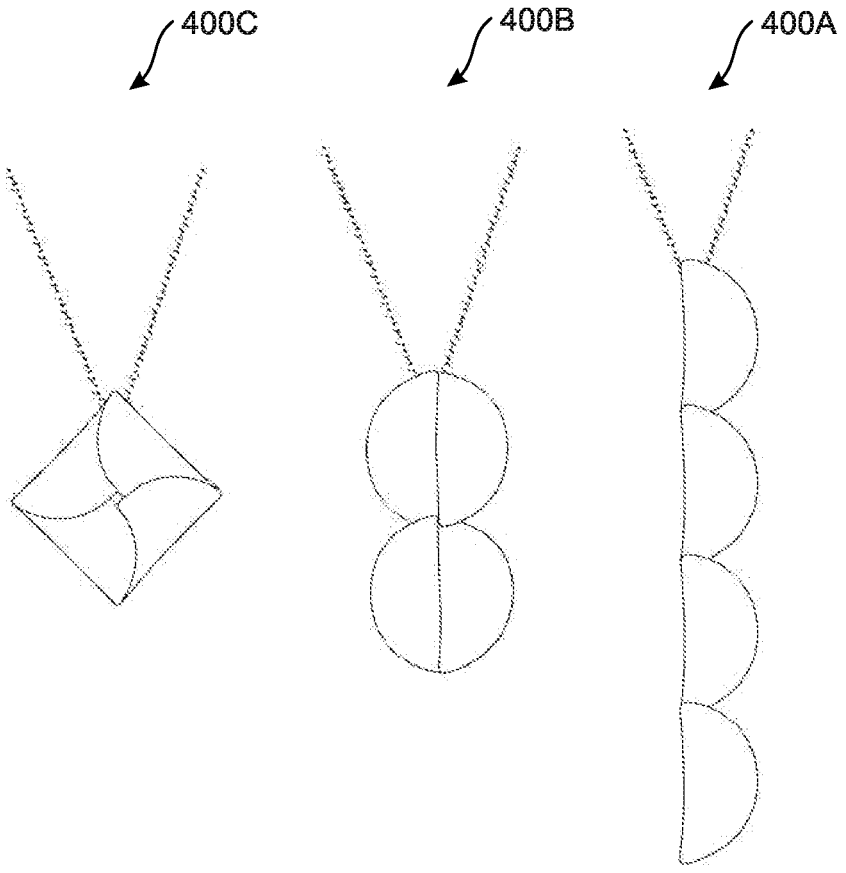
FIG. 14 is a diagram that illustrates a front view of the wearable device in other possible configurations, according to another exemplary embodiment of the present invention.

FIG. 10 is a diagram that illustrates a perspective view of the wearable device 300 in a triangle configuration, according to another exemplary embodiment of the present invention. FIG. 11 is a diagram that illustrates a front view of the wearable device 300 in the triangle configuration, according to another exemplary embodiment of the present invention. FIG. 12 is a diagram that illustrates a rear view of the wearable device 300 in the triangle configuration, according to another exemplary embodiment of the present invention. FIG. 13 is a diagram that illustrates a side view of the wearable device 300 in the triangle configuration, according to another exemplary embodiment of the present invention. The wearable device 100 corresponds to a pendant that is designed to be hung from the necklace 102. In an embodiment, the pendant includes a plurality of components such as the first component 104, the second component 106, and the third component 108. Each component has three closing surfaces and one open surface. Each component has a thinner end portion (without any opening) and a thicker end portion (with an opening). In an embodiment, the first component 104 includes the clasp or hook or affixing mechanism 110 located on a rear, front, or top side. The clasp 110 has an opening through which the necklace 102 may pass through. In an embodiment, the plurality of components are connected to each other in a hinged manner such that it forms a triangular configuration as shown. For example, the first component 104 is connected to the second component 106 in a hinged manner such that the components can rotate around the hinged connection. Here, the thinner end portion of the first component 104 goes into the opening of the thicker end of the second component 106 and are then connected together in the hinged manner by using appropriate means such as screws or others that are known in the art. Similarly, the second component 106 is connected to the third component 108 in a hinged manner such that the components can rotate around the hinged connection. Thereafter, the thinner portion of the third component 108 is inserted into the opening of the thicker portion of the first component 104 and are tighten to form a closed triangular configuration as shown. In this configuration, the opening on the thicker end of each component is on the interior circumference as shown. In the triangular configuration of the pendant, the closed surfaces of each component are facing outwards as shown. This triangular configuration of the pendant may be used with the necklace 102 that passes through the clasp 110 to form the wearable device. A user who intends to use this pendant may switch from the straight configuration to the triangular configuration, or vice-versa in an easy and efficient manner FIG. 14 is a diagram that illustrates a front view of other wearable devices in other possible configurations, according to another exemplary embodiment of the present invention. Here, the plurality of components includes at least four components such as a first component, a second component, a third component, and a fourth component, as shown. These components may be connected in a hinged manner and may be used in a straight configuration 400A. For example, the first component is connected to the second component, which is connected to the third component, and which is connected to the fourth component to form the straight configuration as shown. In another scenario, each pair of two components may be connected together to form two circular configuration setup 400B. Using this setup, the pendant may include two circular designs connected together to form the pendant that can be used with the necklace to form the wearable device. For example, the first component is connected to the second component, which is connected to the third component, and which is connected to the fourth component. Thereafter, the fourth component and the third component are connected to the first component and the second component respectively to form the two circles as shown. In another scenario, each component is connected to the next component to form a square configuration 400C. For example, the first component is connected to the second component, which is connected to the third component, and which is connected to the fourth component, and which is finally connected to the first component to form the square configuration as shown. Here, in each configuration, one component is connected to the next component by using the insertion mechanism.

Figure 15:
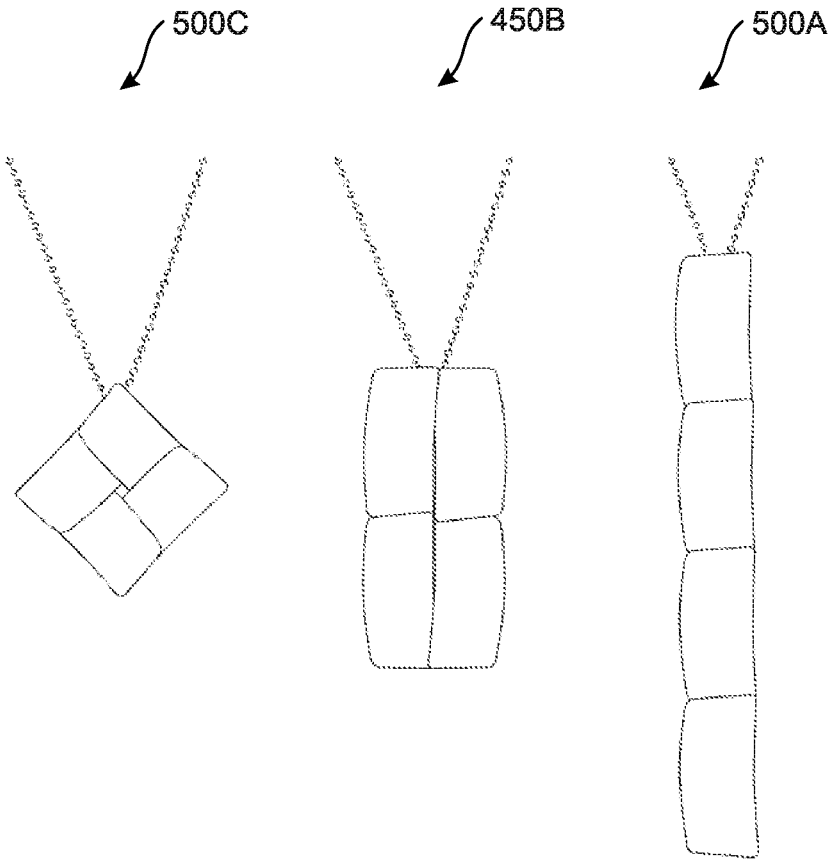
FIG. 15 is a diagram that illustrates a front view of other wearable devices in other possible configurations and designs, according to another exemplary embodiment of the present invention.

FIG. 15 is a diagram that illustrates a front view of other wearable devices in other possible configurations and designs, according to another exemplary embodiment of the present invention. Here, the plurality of components includes at least four components such as a first component, a second component, a third component, and a fourth component, as shown. These components may be connected in a hinged manner along the edge and may be used in a straight configuration 500A. For example, the first component is connected to the second component, which is connected to the third component, and which is connected to the fourth component to form the straight configuration 500A. In another scenario, each pair of two components may be connected together to form two rectangular configuration setup 500B. Using this setup, the pendant may include two rectangle designs connected together to form the pendant that can be used with the necklace to form the wearable device. For example, the first component is connected to the second component, which is connected to the third component, and which is connected to the fourth component. Thereafter, the fourth component and the third component are connected to the first component and the second component respectively to form the two rectangles as shown. In another scenario, each component is connected to the next component to form a square configuration 500C. For example, the first component is connected to the second component, which is connected to the third component, and which is connected to the fourth component, and which is finally connected to the first component to form the square configuration as shown. However, a person having ordinary skills in the art would understand that the above affixing or assembling mechanism is for illustrative purpose and should not be entirely considered as limiting to the scope of the present invention. In some use cases, the pendant may be designed in a way such that the design lends itself to go in both ways. In this design, the pendant may rotate on a hinge in either way, when two open spaces (i.e., two openings) are included on each end.

Figure 16:
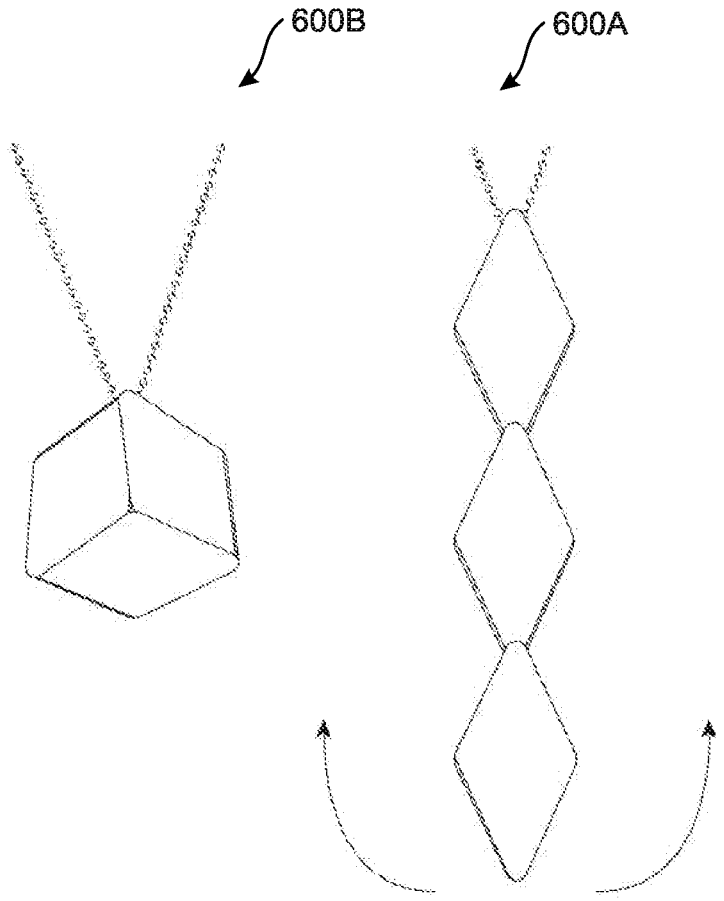
FIG. 16 is a diagram that illustrates a front view of the wearable device in other possible configurations, according to another exemplary embodiment of the present invention.

FIG. 16 is a diagram that illustrates a front view of the wearable device in other possible configurations, according to another exemplary embodiment of the present invention. Here, the plurality of components includes three components such as a first component, a second component, and a third component, as shown. These components may be connected in a hinged manner along the edge and may be used in a straight configuration 600A. For example, the first component is connected to the second component, which is connected to the third component to form the straight configuration 600A. In another scenario, the plurality of components may be connected together to form a cubical (2-dimensioanl) configuration setup 600B. In another scenario, the plurality of components may be connected together to form a hexagonal (6-sided shape) configuration setup 600B.

Figure 17:
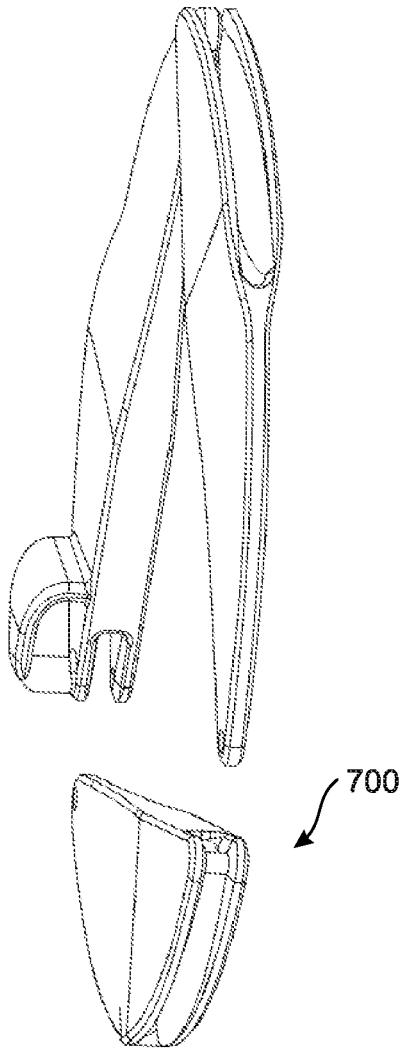
FIGS. 17 and 18 are diagrams that illustrate a pin attachment setup for the wearable device, according to an exemplary embodiment of the present invention.
Figure 18:
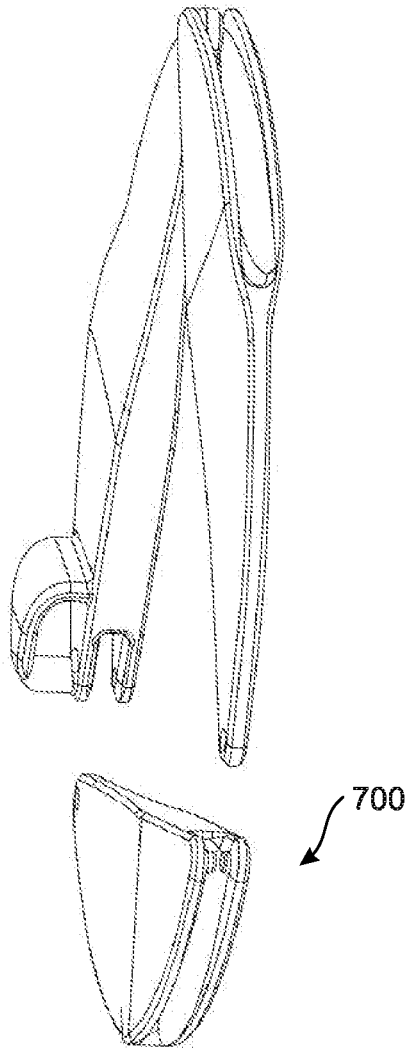

FIGS. 17 and 18 are diagrams that illustrate a pin attachment setup 700 for the wearable device, according to an exemplary embodiment of the present invention. The pin attachment setup may include a bar/wire through each component. In some other scenario, each component may have two teeth or prongs on each side that then clamp down on the next component with the corresponding hole for the teeth or prongs to clamp into to create a rotating mechanism or hinge.

FIGS. 19*a*, 19*b*, and 19*c* are diagrams that illustrate different clasping mechanisms for the wearable device, according to an exemplary embodiment of the present invention. In an exemplary embodiment, FIG. 19*a* illustrates a clasping mechanism implemented by using a clip 802 and a ball bearing 804. The clip 802 is a stainless clip having two parallel openings 802*a*. The clip 802 is inserted into a first component of the wearable device 800*a* such that it fits therein precisely within the edged boundary that prevents any slipover of the clip 802 from the first component. The ball bearing 804 is stainless steel ball bearing that is configurable to set inside an opening 804*a* in the third component of the wearable device 800*b*. For example, as shown in the wearable device 800*c*, both the clip 802 and the ball bearing 804 are placed at their respective places in the first component and the third component. Further, as shown in the wearable device 800*d*, the third component is inserted into the first component such that the ball bearing 804 fits into the openings 802*a* of the clip 802 and locks the first and third components with each other.

In another exemplary embodiment, FIG. 19*b* illustrates a clasping mechanism implemented by using magnet(s). A first component of the wearable device 900*a* includes a magnet holder 904 that is designed to hold a cup shaped magnet 902. As shown in the wearable device 900*b*, the magnet 902 is placed on the magnet holder. Further, as shown in the wearable device 900*c*, a third component of the wearable device 900*c* includes a half round magnet 906. Further, as shown in the wearable device 900*d*, when the third component is inserted into the first component, the magnets 902 and 906 attracts each other and locks the first and third components with each other.

In another exemplary embodiment, FIG. 19*c* illustrates a clasping mechanism implemented by using a spring button. The spring button may include a button 1002, a coil spring 1004, and a set screw 1006. As shown, a first component of the wearable device 1000*a* includes a vertical portion 1008 having an opening. The button 1002 is inserted into this opening, and then the spring 1004 is inserted into it, and then the screw 1006 is used to tighten and close this opening. When closed, a portion of the button 1002 is visible from top as shown in the wearable device 1000*b*. This button is pressable and is configured to toggle up and down as pressed. Thus, when a third component of the wearable device 1000*c* is inserted into the first component, the button 1002 is pressed down and then move up to fit into an opening in the third component. This way the first and third components lock with each other.

Techniques consistent with the disclosure provide, among other features, the modular pendant that can be used as a necklace piece, an earring, a key ring, a sculpture, a bench, a lock, or a bracelet. In some other applications, the pendant may be used as a decorative piece on a bag, purse, or belt. While various embodiments of the disclosure have been illustrated and described, it will be clear that the disclosure is not limited to these embodiments only. Numerous modifications, changes, variations, substitutions, and equivalents will be apparent to those skilled in the art, without departing from the spirit and scope of the disclosure, as described in the claims.

Although particular embodiments of the invention have been described in detail for purposes of illustration, various modifications and enhancements may be made without departing from the spirit and scope of the invention. The scope of the invention is accordingly defined by the following claims.

I claim:

1. A device, comprising:

a pendant including a series of components including at least a first component, a second component, and a third component, wherein each component includes a curved surface intersecting a flat surface at two intersections at opposite ends of the flat surface, each intersection having a thickness, one intersection is thinner and one intersection is thicker, the thicker intersection having an opening;

wherein the components are connected in series by inserting the thinner intersection within the opening of an adjacent thicker intersection, such that each component can rotate; and a hook that is fixed to a rear or top portion of the first component, wherein the hook includes a pass-through opening; and a neckpiece that is allowed to pass through the opening of the hook fixed to the first component, wherein the pendant has an unfolded configuration in which the series of components are open, and a folded configuration in which the series components is closed.

2. The device of claim 1, wherein the unfolded configuration corresponds to all flat surfaces forming a straight line.

3. The device of claim 1, wherein the folded configuration corresponds to a circular configuration of the pendant in which the curved surfaces form an exterior circumference.

4. The device of claim 1, wherein the folded configuration corresponds to a triangular configuration of the pendant in which the flat surfaces of each component are facing outwards.

5. The device of claim 1, wherein the pendant includes a fourth component, and the folded configuration corresponds to a square configuration of the pendant in which said flat surfaces of each component are facing outwards.

6. The device of claim 1, wherein the pendant includes a fourth component, and the folded configuration corresponds to a double circle configuration of the pendant in which said rounded surfaces of each component are facing outwards.

7. The device of claim 1, wherein the pendant is usable as a key ring, an earring, and a bracelet.

8. The device of claim 1, wherein the series is held in the folded configuration by further comprising a clasp, wherein the clasp comprises a clip and a ball bearing, wherein the clip is a stainless steel clip having two parallel openings, and wherein the ball bearing is a stainless steel ball that fits into the parallel openings.

9. The device of claim 1, wherein the series is held in the folded configuration by furthercomprising a clasp, wherein the clasp comprises a cup shaped magnet and a half round magnet, wherein the magnets attract each other and locks the first and third components from the plurality of components.

10. The device of claim 1, wherein the series is held in the folded configuration by furthercomprising a clasp, wherein the clasp comprises a spring button realized using a button, a spring, and a screw.

* * * * *